United States Patent [19]

Armstrong

[11] Patent Number: 4,629,032

[45] Date of Patent: Dec. 16, 1986

[54] BUILDING WALL DESCENT DEVICE HAVING A MANUALLY OPERATED BRAKE MEANS

[76] Inventor: James A. Armstrong, 2055 Mills Ave., Cincinnati, Ohio 45212

[21] Appl. No.: 740,314

[22] Filed: Jun. 3, 1985

Related U.S. Application Data

[63] Continuation-in-part of Ser. No. 534,307, Sep. 21, 1983, Pat. No. 4,520,895.

[51] Int. Cl.[4] ..... A62B 1/20

[52] U.S. Cl. ..... 182/9; 182/82

[58] Field of Search ..... 182/3, 5–7, 182/9, 82, 193, 10, 189

[56] References Cited

U.S. PATENT DOCUMENTS

| | | | |
|---|---|---|---|
| 275,608 | 4/1883 | Drake | 182/240 |
| 2,647,675 | 8/1953 | Bernett | 182/82 |
| 3,207,263 | 9/1965 | Cull | 182/82 |
| 4,121,689 | 10/1978 | Bonvin | 182/3 |
| 4,350,224 | 9/1982 | Jochum | 182/82 |
| 4,406,349 | 9/1983 | Vilchek | 182/82 |
| 4,499,966 | 2/1985 | Milne | 182/82 |
| 4,520,895 | 6/1985 | Armstrong | 182/3 |

*Primary Examiner*—Reinaldo P. Machado

*Attorney, Agent, or Firm*—Frost & Jacobs

[57] ABSTRACT

The present invention contemplates a descent device including a roller having an annular groove about its contact surface, a support structure to which the roller is rotatably attached, a pinion gear rotatably attached to the support structure, a rotor disk directly coupled to the pinion gear, a braking device coupled to the support structure for controlling the speed of rotation of the rotor, a hand held actuator for activating the brake device, and a sling attached to the support structure capable of supporting a person who can control his or her descent by actuating the brake device, enabling a person to escape from a building during emergency conditions.

The present invention also contemplates the combination of the above-described descent device and a vertically extending rail-like support track which is fixedly secured to the exterior of a building wall. The track is shaped substantially like an I-beam in which one edge of the I-beam includes a plurality of recesses and projections to form a rack designed to correspond with the pinion gear of the descent device, while the other edge of the I-beam is straight and smooth and is designed to correspond with the roller whose contact surface contacts the smooth edge.

21 Claims, 3 Drawing Figures

BUILDING WALL DESCENT DEVICE HAVING A MANUALLY OPERATED BRAKE MEANS

RELATED APPLICATION

This application is a continuation-in-part of U.S. patent application Ser. No. 534,307, filed Sept. 21, 1983 now U.S. Pat. No. 4,520,895.

BACKGROUND OF THE INVENTION (1) Field of the Invention

The present invention relates to an improved manually operated device for lowering a person along the exterior face of a building wall and in particular, the present device is particularly useful under emergency conditions to provide a means for escape from a building.

(2) Prior Art

There have been many types of devices proposed for lowering a person to the ground along an exterior face of a building wall. One of the problems with such devices is controlling the speed of descent. If the user descends too quickly, he may be injured by contact against the building wall, or the ground. Controlling the speed of descent is even more critical under emergency escape conditions, where the user may be inexperienced or partially incapacitated, and under emotional stress. Under such circumstances it is preferred that the device be of simple construction, foolproof, and easily operated.

U.S. Pat. No. 275,608 to Drake, patented on Apr. 10, 1883, discloses a fire escape device having a drum mounted upon an axle. The device includes a pair of snap hooks at each end of the drum and a rope wound about the drum with a loop secured at one end thereof. A braking device is included which comprises a slide pin which is in frictional engagement with one of the side walls of the drum and is activated by a pivoted lever. When the lever is manually pivoted, one end thereof contacts the frictional pin causing it to engage the side wall of the drum.

The Drake device is not designed to be employed with a rail vertically attached to the exterior face of a building.

U.S. Pat. No. 2,647,675 to Bernett, issued on Aug. 4, 1953, discloses a gasoline powered car designed to travel along the vertical face of a building in order to rescue persons from the building during emergency conditions. The car travels along an I-beam secured to the vertical face of a building. Along one flange of the I-beam includes a rack having a plurality of teeth designed to mesh with a rotating gear directly coupled to the car. The vehicle includes a braking system comprising a pair of brake shoes securely mounted to the frame of the vehicle. The brake shoes have semi-circular linings and are designed to frictionally engage a brake drum which is mechanically coupled to the gear which engages the rack. In this manner the vehicle may be stopped at any point along the rack.

U.S. Pat. No. 4,406,349 to Vilchek issued on Sept. 27, 1983 discloses an emergency escape apparatus which includes a gear track mounted vertically on the exterior surface of a building. A carriage is provided with guide rollers which engage a guide track oriented adjacent and parallel to the gear track. A gear wheel is rotatably mounted on the carriage and is maintained in positive engagement with the gear track by the guide rollers. The carriage includes automatic brakes which serve to limit the maximum downward velocity of the carriage. A boatswain's chair is attached to the carriage to transport one or more individuals down the vertical face of the building. The brake system includes a centrifugal brake and a cam brake. The cam brake includes a plurality of brake pads mounted in semi-circular fashion around a brake drum to which force is applied by a plurality of semi-circular brake bands.

The above devices are unsafe or too complicated and do not accurately control the speed of descent, particularly under emergency conditions where the user may be inexperienced or partially incapacitated, and under emotional stress. Accordingly, there exists a need for a device for manually lowering a person from a building along the exterior face of the building.

SUMMARY OF THE INVENTION

The present invention is directed to a descent device where the speed of descent is under complete manual control of the user. The device itself includes a roller having an annular groove about its contact surface or periphery. The roller is attached to a support structure which also mounts a pinion gear. The roller is designed to engage one edge of a vertically extending flange-like track while the pinion gear engages the other edge of the flange-like track provided with rack teeth. The roller is attached to the support structure by means of a single shaft. The roller and its shaft pivot with respect to the support structure and the pinion gear so as to enable the attachment of the device to the track at any point along the exterior face of the building.

In another modification of the invention, a stop block is employed to prevent the contact roller from pivoting away from the pinion gear and support structure. In this modification, the device must first be canted downwardly so that the axes of the pinion gear and the contact roller approach the same horizontal plane, in order to mount the device on the track.

Both modifications include a disk rotor securely fastened to the pinion gear in such a manner that it rotates with the pinion gear. Additionally, a brake device is secured to the support structure and is capable of being activated to frictionally engage the rotor to control the speed of rotation of the pinion gear. The brake device includes a handle grip which can be operated by a person to cause the brake device to frictionally engage the rotor. The support structure has secured thereto a sling, or the like, for suspending a person from the support structure in such a manner that the person is able to operate the handle grip of the brake means, thus controlling his or her descent.

In the broadest sense, the present invention comprises a descent device containing a freely rotating contact roller and a pinion gear, both of which are secured to a support structure, a rotor fixedly secured to the pinion gear so that the rotor rotates with the pinion gear, a brake device secured to the support structure, including a handle grip to operate the brake device, and a sling suspended from the support structure designed to suspend a person from the descent device.

The flange-like track is fixedly secured to the exterior face of a building wall. The track comprises an I-beam, having a pair of parallel inner and outer flanges joined by a central web, and extends the vertical height of the building. The inner flange of the track is affixed to the building wall. The outer flange has a smooth edge and a rack-like toothed edge to cooperate with the pinion gear. The smooth edge of the outer flange cooperates with the roller.

Further details of the invention will become apparent from the drawings and the detailed description which follows.

DETAILED DESCRIPTION OF THE PREFERRED EMBODIMENT

Figure 1:
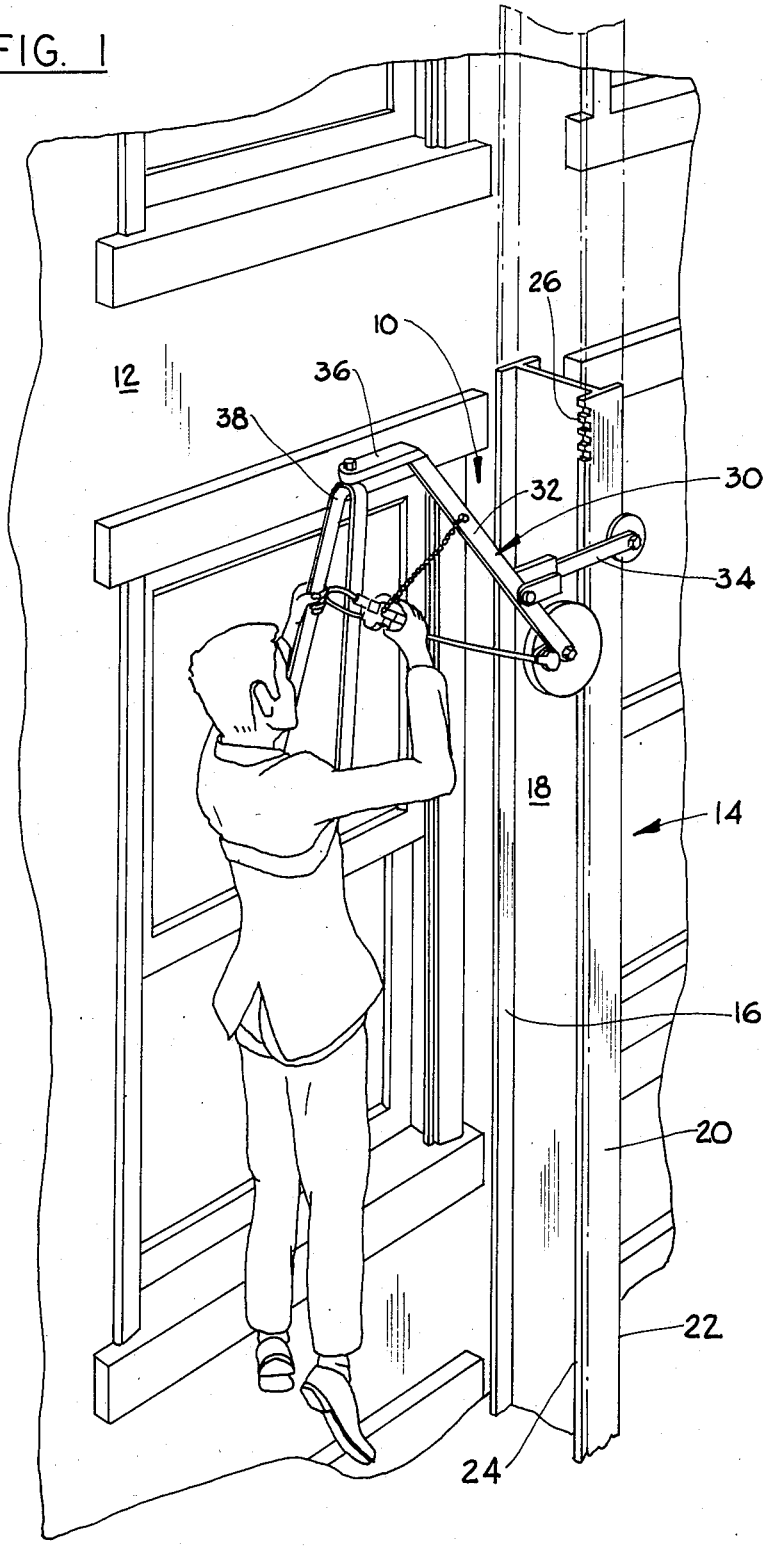
FIG. 1 is a fragmentary environmental view of the device in operation.
Figure 2:
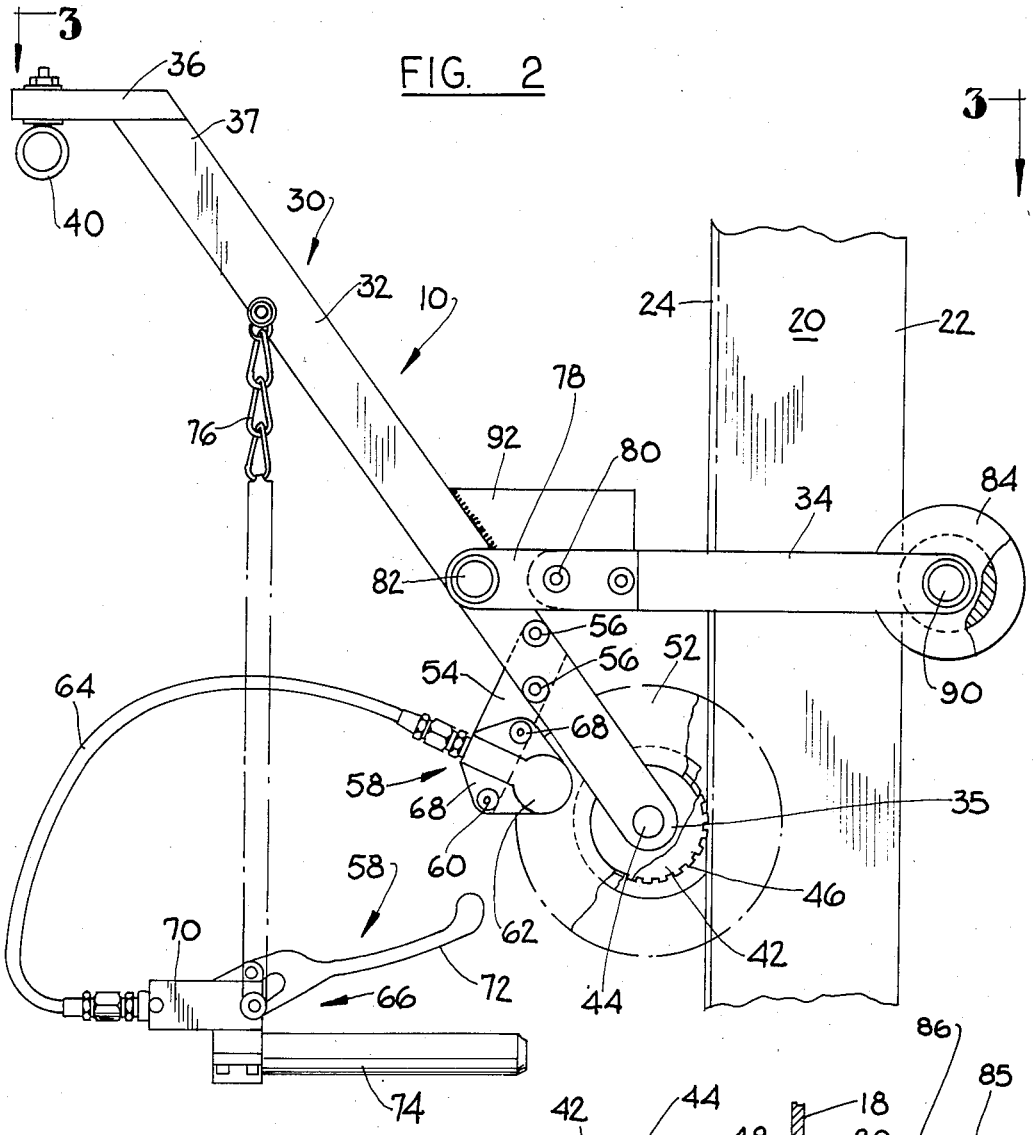
FIG. 2 is a fragmentary side elevational view of the descent device of the present invention.
Figure 3:
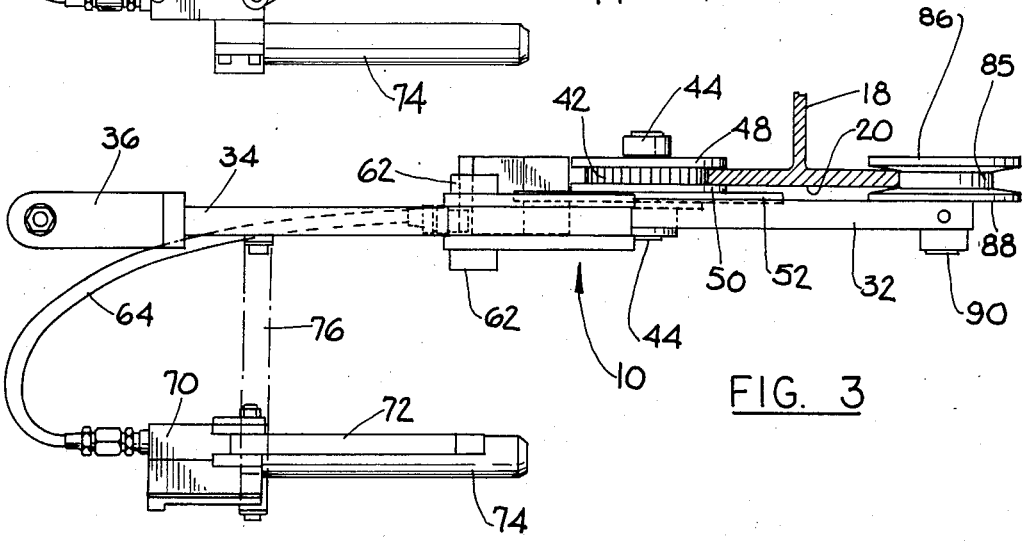
FIG. 3 is a plan view, partly in cross-section of the descent device.

As illustrated in FIGS. 1–3, the descent device 10 of the present invention is designed to lower a person along the exterior vertical face 12 of a building on a complimentary vertically positioned I-beam track 14. The I-beam 14 has an inner flange 16 securely fastened to the vertical face of a building 12 in any conventional manner, such as with bolts (not shown). The I-beam 14 includes a conventional web portion and an outer flange 20 which is parallel to the secured face 16. In general, both the outer flange 20 and the inner flange 16 of the I-beam 14 are parallel to the exterior face 12 of the building and join the web portion 18 at their respective longitudinal centers. The outer flange 20 includes a smooth edge 22 and a rack-like edge 24 provided with teeth 26.

In general, the I-beam 14 may be formed of any metal capable of being securely fastened to a vertical face of a building and being sufficiently strong to support a plurality of people at any one time during operation of the descent device 10. For example, the I-beam 14 may be made from steel, aluminum, or the like. Preferably, the beam is formed of aluminum since aluminum does not oxidize and thus will not detract from the general overall exterior appearance of the building.

The descent device 10 includes a support structure 30 comprising an elongated bar 32. A short arm 34 is pivotally fastened to the bar 32 at a point between the center of the longitudinal length of the bar 32 and a first end 35 thereof. A support 36 is affixed to the second end 37 of the bar 32. The support structure 30, as illustrated in FIG. 1, may be made from any conventional material sufficiently strong to readily support a person. For example, the support structure 30 may be made of metal, such as iron, stainless steel, or preferrably aluminum. Aluminum is preferred because it does not readily oxidize, is lightweight, and is widely available.

Secured to the free end of the support 36 is a sling 38 designed to suspend a person from the descent device 10. As illustrated in FIG. 2, the sling may be secured to the support 36 in any conventional manner, such as an eye-bolt 40, which is affixed to the free end of the support 36. The sling 38 can comprise a simple loop, for example, or it may comprise a more complex sling designed to fit about the body and include a seat portion. The sling can be made of any material capable of supporting the weight of a human being. Suitable materials for the sling 38 comprise, leather, fabric, rope, various plastics, composite materials, and metal, particularly in the form of chains, cable and the like.

Secured to the bar 32 at its first end 35 is a pinion gear 42, as illustrated in FIGS. 2 and 3. The pinion gear 42 is secured to the bar 32 by means of a shaft 44 which extends laterally of the bar 32 and upon which the pinion gear is rotatably mounted. The pinion gear 42 has a plurality of teeth 46, as illustrated in FIG. 2, around its circumference. The teeth 46 are sized and dimensioned so as to cooperate with the rack 24 of the I-beam 14. Secured to each side of the pinion gear 42 is a pair of disk plates 48 and 50 integrally formed with the pinion gear 42. Both disk plates 48 and 50 extend radially beyond the pinion gear 42, as clearly illustrated in FIG. 3. When the pinion gear 42 engages the rack 24 of the I-beam 14, the plates 48 and 50 extend to either side of the rack 24, preventing the pinion gear 42 from shifting laterally off the rack during operation.

Plate 50, adjacent the bar 32, has integrally formed thereon or attached thereto a large rotor disk 52 which is parallel with plate 50. Thus, rotor 52, plates 48 and 50, and pinion gear 42 simultaneously rotate with one another about the shaft 44.

A short bracket 54 has one end secured to the bar 32 between the short arm 34 and the rotor 52. The bracket 54 is securely attached, for example, by a pair of recessed hex-head bolts 56. However, the short bracket 54 may be attached to the bar 32 by any conventional means. Attached to the free end of the short bracket 54 is a braking device generally indicated by reference numeral 58. The braking device 58 is attached to short bracket 54 by a pair of recessed hex-head bolts 60, for example.

The braking device 58 is preferably of the hydraulic type, in which a pad is positioned on each side of the rotor, as is conventionally known, e.g. in connection with a motorcycle brake.

The preferred braking device 58 comprises three components consisting of the brake pads 62, the hydraulic line 64 and the handle actuator means 66. The brake pads 62 may be of any conventional type, such as those frequently associated with a rotor. The brake pads are retained in a brake housing 66. Directly coupled with the brake housing 66 is the hydraulic line 64 whose opposite end is coupled with the handle control actuator 66. The handle control actuator 66 includes a hydraulic fluid reservoir 70 directly coupled with the hydraulic line 64, and a pivotable handle 72 which actuates a hydraulic piston (not shown) in the conventional manner. Additionally, the handle control actuator 66 comprises a grip bar 74 employed to enable the operator to manually squeeze the pivotable handle 72 toward the grip bar 74 in order to actuate the hydraulic brake 58. The pivotable handle 72 is suspended from the bar 32 by means of a chain 76 in order to prevent the pivotable handle from freely swinging and to prevent crimping the hydraulic line 64.

The braking system may also be of the mechanical type, well known to those skilled in the art. The brake pads are retained in a brake housing 66.

Connection of the short arm 34 of the bar 32 is accomplished by a short beam 78 directly attached thereto by means of a pair of recessed hex-head bolts 80, for example. The short beam 78 is directly attached to the bar 32 by means of a pin 82 in order to permit the short arm 34 and short beam 78 to pivot with respect to the bar 32. A roller 84 is attached to the free end of the short arm 34. The roller 84 has a peripheral groove 85 forming a pair of spaced annular flanges 86 and 88. The groove 85 is the contact portion of the roller 84, and contacts the smooth edge 22 of the flange 20 of I-beam 14 during operation, with flanges 86 and 88 located to either side thereof. The roller 84 is rotatably mounted on the short arm 34 by means of a shaft 90 which extends laterally thereof. The short arm 34 is of such length as to enable the pinion gear 42 and roller 84 to properly engage their respective edges of the I-beam outer flange 20.

In operation, when it is desired to escape a building under emergency conditions, the descent device 10 may be employed by placing the roller 84 against the smooth edge 22 of the I-beam outer flange 20 and placing the pinion gear 42 against the rack edge 24 thereof in the manner shown in FIG. 2. In order to accomplish this using that embodiment of the descent device 10 not provided with stop block 92, the short arm 34 is pivoted upwardly so that the roller 84 and pinion gear 42 are spaced the maximum distance from one another, thus allowing the roller 84 to be placed into contact with the smooth outer flange edge 22. Thereafter, the bar 32 is pulled downwardly, causing the pinion gear 42 to move toward roller 84 and into contact with the rack edge 24 of outer flange 20. Because the short arm 34 is pivotable with respect to the bar 32 about pin 82, the descent device 10 may be quickly connected or coupled with the I-beam 14.

In a second embodiment, a stop means block 92 may be employed which is welded to bar 32 immediately above the short beam 78 for the purpose of preventing the short beam 78 and short arm 34 from pivoting upwardly with respect to the angle member 34. When the stop block 92 is employed, the descent device may still be quickly coupled to the I-beam 14. However, the bar 32 must be substantially vertical and parallel with the rack edge 24 of the I-beam outer flange 20 in order to enable the roller 84 and the pinion gear 42 to be properly engaged with the I-beam 14.

Once the descent device is properly attached to the I-beam, the operator applies the brake means 58 by squeezing the handle 72 toward the grip bar 74 in order to prevent the descent device from descending along the I-beam. The operator, who is in the sling 38, then swings out so as to suspend himself or herself from the descent device 10 and slowly releases the handle 72 to release the brake pads 62 in order to permit the pinion gear 42 to rotate down the rack 24 in a controlled manner, thus permitting the operator to descend along the vertical face of the building to ground level.

In both embodiments, the descent device 10 has an inherent characteristic that the weight of a user acts as a cantilever force causing both the roller 84 and the pinion gear 42 to be forced toward each other to tightly squeeze or clamp the outer flange 20 of the I-beam 14 therebetween.

Modification of the present invention may be made without departing from the spirit of it. For example, short beam 78 and short arm 34 may be a single, unitary structure of such length as to properly fit the I-beam. Additionally, all bolts could be replaced by welds, or other fastening means. The beam 14 may have any appropriate cross-sectional configuration or construction so long as it provides an outer flange 20 spaced from the building wall.

What is claimed is:

1. Apparatus for descending in a controlled fashion along an exterior building wall having a vertical extending beam, provided with a longitudinal rack edge and a longitudinal smooth edge, said apparatus comprising: a support structure; a roller rotatably secured on said support structure, said roller designed to engage said smooth edge of said beam; a pinion gear rotatably secured to said support structure and designed to contact said rack edge of said beam; a brake means attached to said support structure for controlling the speed of rotation of said pinion gear, thereby controlling the rate of descent; and a sling means attached to said support structure for supporting the user; wherein said support structure includes an elongated bar, said pinion gear being rotatably mounted on said elongated bar by means of a shaft extending laterally from one end of said bar.

2. The apparatus according to claim 1, wherein said roller has a peripheral groove which contacts said smooth edge of said beam, and a pair of spaced annular flanges located to either side of said smooth edge.

3. The apparatus according to claim 2, wherein said support structure includes a short arm pivotally attached at one end to the remainder of said support structure and rotatively mounting said roller at its other end.

4. The apparatus according to claim 3, wherein said support structure includes a stop block secured thereto to prevent pivoting of said short arm away from said pinion gear.

5. The apparatus according to claim 1, wherein said pinion gear includes a toothed gear portion having a width substantially the same as the width of said rack edge of said beam, said pinion gear also including a pair of parallel disk plates axially positioned on each side of said toothed portion, each of said disk plates having a radius larger than the radius of said toothed gear portion.

6. The apparatus according to claim 5, wherein said pinion gear includes a rotor disk axially attached to one of said disk plates, said rotor disk having a diameter larger than said disk plates.

7. The apparatus according to claim 6, wherein said brake means includes a pair of disk pads positioned on opposite sides of said rotor disk, said disk pads being hydraulically activated, and said brake means including a hand held control designed to apply hydraulic pressure to said disk pads.

8. The apparatus according to claim 7, further including a hydraulic conduit extending between said brake pads and said hand held control, thereby permitting hydraulic fluid to be pressurized by said hand held control and to correspondingly apply pressure to said brake pads.

9. The apparatus according to claim 8, wherein said support structure includes means to suspend said handle control means therefrom in order to prevent crimping said hydraulic conduit.

10. The apparatus according to claim 1, wherein said other end of said elongated bar includes means to securely attach said sling means thereto.

11. Apparatus for descending in a controlled fashion along an exterior building face wall comprising a vertically extending I-beam, said I-beam having an inner flange, an outer flange and a connecting web portion, said I-beam inner flange being fixedly secured to the exterior of the building wall face, said I-beam outer flange having a smooth edge and a rack edge; said descent device including a support structure; a contact roller rotatably secured on said support structure and designed to engage said smooth edge of said I-beam outer flange; a pinion gear rotatably secured to said support structure and designed to engage said rack edge of said I-beam with flange, a brake means attached to said support structure for controlling the speed of rotation of said pinion gear, thereby controlling the rate of descent; and a sling means attached to said support structure for supporting the user.

12. The apparatus according to claim 11, wherein said roller has a peripheral groove which contacts said smooth edge of said beam, and a pair of spaced annular flanges located to either side of said smooth edge.

13. The apparatus according to claim 12, wherein said support structure includes a short arm pivotally attached at one end to the remainder of said support structure and rotatively mounting said roller at its other end.

14. The apparatus according to claim 13, wherein said support structure includes a stop block secured thereto to prevent pivoting of said short arm away from said pinion gear.

15. The apparatus according to claim 11, wherein said pinion gear includes a toothed gear portion having a width substantially the same as the width of said rack edge of said beam, said pinion gear also including a pair of parallel disk plates axially positioned on each side of said toothed portion, each of said disk plates having a radius larger than the radius of said toothed gear portion.

16. The apparatus according to claim 15, wherein said pinion gear includes a rotor disk axially attached to one of said disk plates, said rotor disk having a diameter larger than said disk plates.

17. The apparatus according to claim 16, wherein said brake means includes a pair of disk pads positioned on opposite sides of said rotor disk, said disk pads being hydraulically activated, and said brake means including a hand held control designed to apply hydraulic pressure to said disk pads.

18. The apparatus according to claim 17, further including a hydraulic conduit extending between said brake pads and said hand held control, thereby permitting hydraulic fluid to be pressurized by said hand held control and to correspondingly apply pressure to said brake pads.

19. The apparatus according to claim 18, wherein said support structure includes means to suspend said handle control means therefrom in order to prevent crimping said hydraulic conduit.

20. The apparatus according to claim 11, wherein said support structure includes an elongated bar, said pinion gear being rotatably mounted on said elongated bar by means of a shaft extending laterally from one end of said bar.

21. The apparatus according to claim 20, wherein said other end of said elongated bar includes means to securely attach said sling means thereto.

* * * * *